United States Patent [19]

McKay

[11] 4,005,543

[45] Feb. 1, 1977

[54] TOY VEHICLE-AIRCRAFT COMBINATION

[76] Inventor: Robert S. McKay, 7420 Beckwith Road, Morton Grove, Ill. 60053

[22] Filed: Sept. 11, 1975

[21] Appl. No.: 612,490

[52] U.S. Cl. ..... 46/81; 46/202

[51] Int. Cl.[2] ..... A63H 27/14

[58] Field of Search ..... 46/81, 202

[56] References Cited

UNITED STATES PATENTS

| | | | |
|---|---|---|---|
| 2,735,221 | 2/1956 | Fields | 46/81 |
| 2,773,321 | 12/1956 | Sherri | 46/81 |
| 3,898,765 | 8/1975 | Lee | 46/81 |

*Primary Examiner*—Hugh R. Chamblee
*Assistant Examiner*—Robert F. Cutting
*Attorney, Agent, or Firm*—Haight, Hofeldt, Davis & Jambor

[57] ABSTRACT

This disclosure includes a primary-secondary vehicle combination toy having means for first propelling the combination for a predetermined distance after which the secondary vehicle is projected into flight for further travel. The combination is preferably propelled along a surface by a portable spring launch while the secondary vehicle is ejected from the primary vehicle by a mounted propulsion unit. This latter propulsion unit may comprise a spring actuated by a distance measuring unit such as an axle drive shaft which controls release of the spring and ejection of the secondary unit for flight away from the primary unit.

12 Claims, 12 Drawing Figures

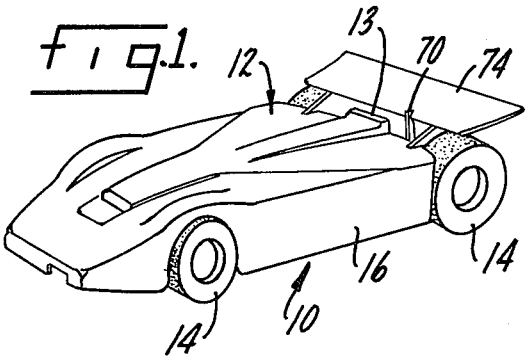
fig.1.
12
13
70
74
16
14
10
14
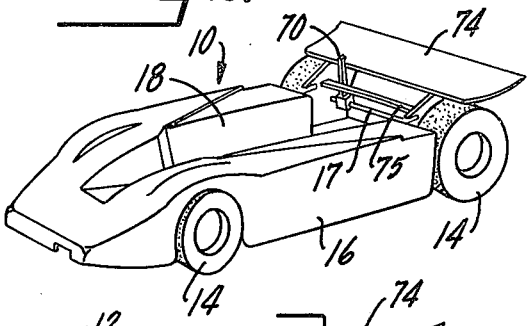
fig.2.
10
18
70
74
17
75
16
14
14
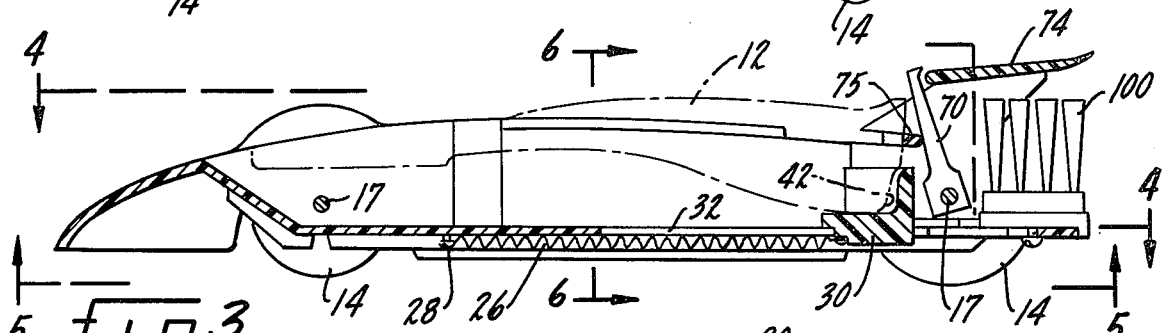
4
6
12
75
70
74
100
42
17
32
4
5
14
28
26
6
30
17
14
5
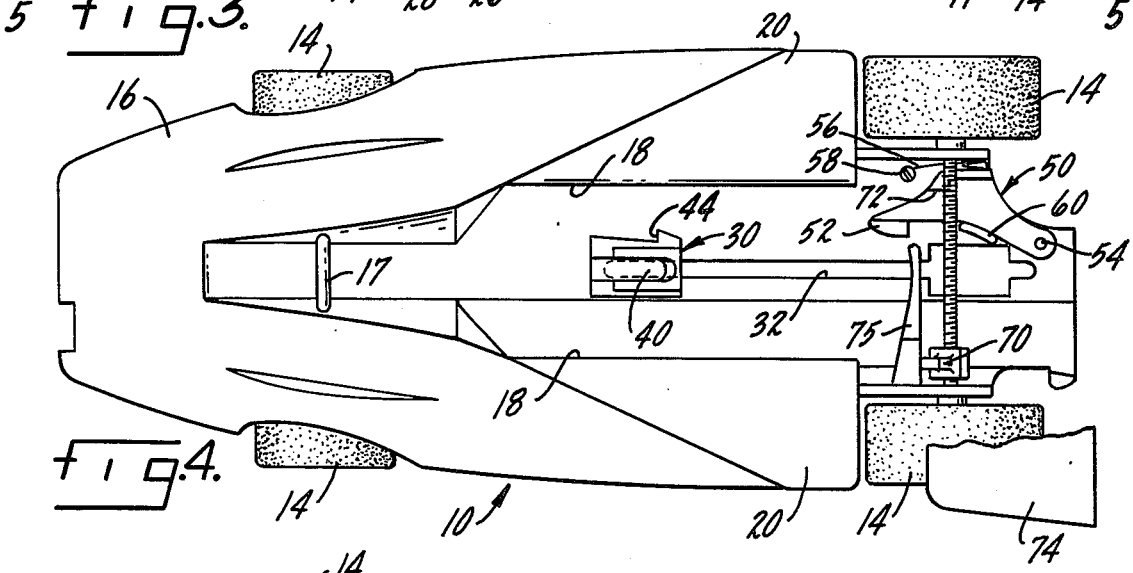
fig.3.
14
20
16
14
56
58
18
50
72
60
44
30
52
54
17
40
32
75
70
18
fig.4.
14
10
20
14
74
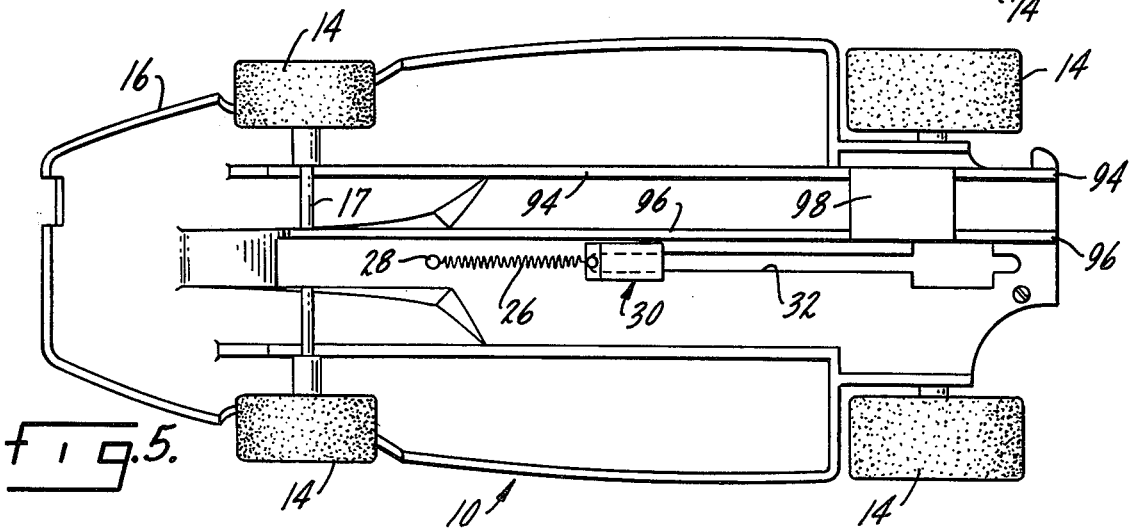
14
16
14
94
17
94
96
98
96
28
26
30
32
fig.5.
14
10
14 fig.6.
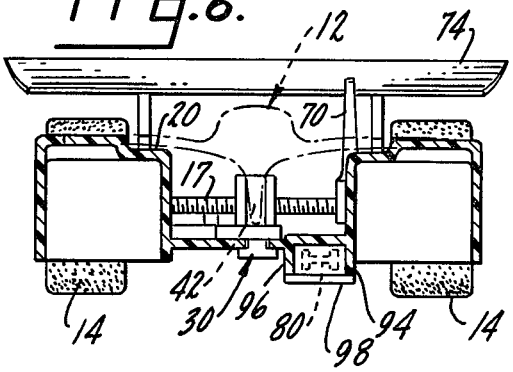
fig.7.
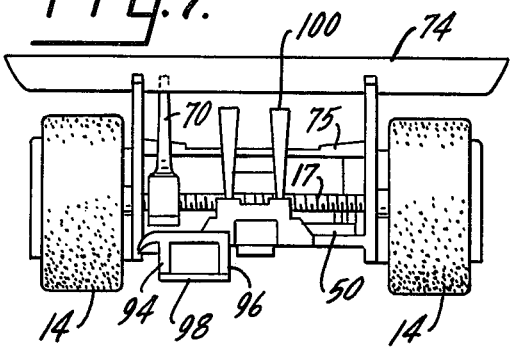
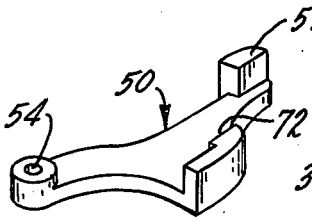
fig.8.
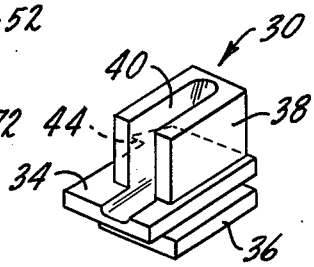
fig.9.
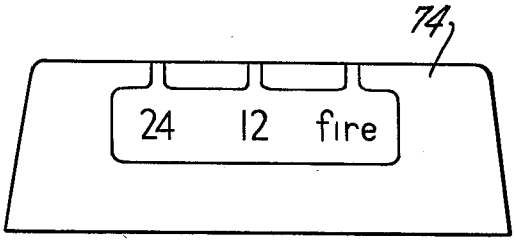
fig.10.
fig.11.
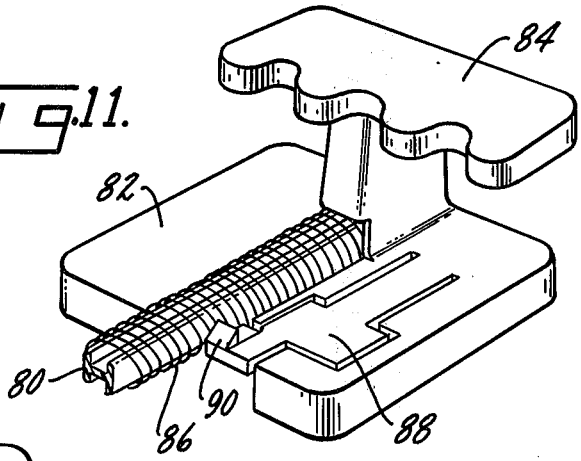
fig.12.
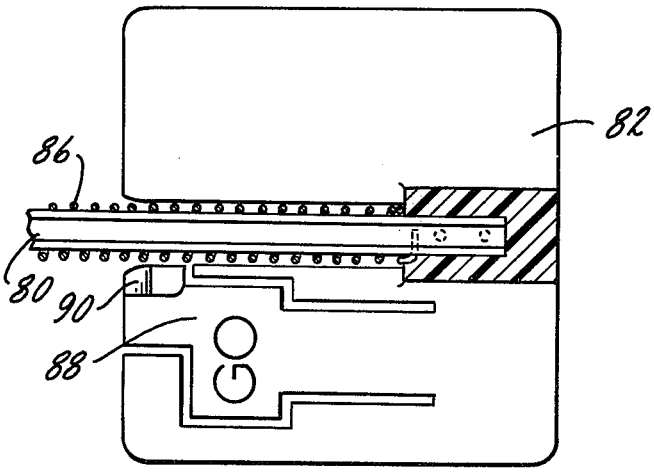

TOY VEHICLE-AIRCRAFT COMBINATION

BACKGROUND OF THE INVENTION

This invention relates to a toy having primary and secondary operations. These dual operations are provided by a primary carrier vehicle such as a miniature automobile, boat or aircraft which supports a secondary vehicle such as an airplane. The primary operation includes propulsion of the combination for a predetermined time or distance after which a secondary vehicle is ejected for flight or ground travel away from the primary carrier. A toy having such dual operations provides far greater interest and amusement than the single operation of most motor or spring propelled toys.

SUMMARY OF THE INVENTION

To provide a more exciting toy, the instant invention includes a primary vehicle such as a miniature automobile propelled by a spring actuated motor such as a windup motor or a spring launch in the nature of a catapult. Mounted on this primary vehicle is preferably an aircraft which is capable of flight or travel away from the primary craft. The flight of the aircraft or secondary operation is effected by a spring propulsion unit mounted on the primary vehicle and is actuated by a time or distance control means which includes a threaded rotating shaft reciprocating an actuator against a detent mechanism to release the spring propulsion unit. The rotation of the shaft and subsequent actuation can be effected by coupling the shaft to the drive wheels, motor or other time or distance mechanisms mounted upon the primary vehicle.

Accordingly, it is an object of this invention to provide an inexpensive dual diverse movement toy which includes combined propulsion of both units with subsequent diverse movement of the two vehicles. More importantly, it is an object to provide such a toy which is simple in construction, but durable, easily operated and capable of manufacture with low tooling and manufacturing costs. The invention is further provided with simple control and propulsion mechanisms and is of such lightweight, low friction design as to facilitate high mobility which increases a child's enjoyment. Another object is to provide a toy in which the operator can preselect the time or distance delay between the combined propulsion and the subsequent ejection of the secondary vehicle for flight away from the primary vehicle.

DESCRIPTION OF THE DRAWINGS

The manner in which these and other objects of the invention are obtained will be made clear by a consideration of the following specification and claims when read in conjunction with the drawings, in which:

FIG. 1 is a perspective view of the preferred embodiment of the primary and secondary vehicles in a position for primary movement;

FIG. 2 is a perspective view of the preferred embodiment of the primary vehicle subsequent to ejection of the secondary vehicle;

FIG. 3 is a side elevation view of the primary vehicle taken adjacent its longitudinal center line and depicts the secondary vehicle in phantom;

FIG. 4 is a plan view taken along the lines 4—4 of FIG. 3 with parts removed for clarity;

FIG. 5 is a plan view taken along the lines 5—5 of FIG. 3 with parts removed for clarity;

FIG. 6 is an elevational view of the preferred embodiment of the primary vehicle taken along the lines 6—6 of FIG. 3;

FIG. 7 is a rear view of the primary vehicle;

FIGS. 8 and 9 are perspective views of components of the secondary propulsion unit carried by the primary vehicle;

FIG. 10 is a plan view of the indicator unit denoting the distance at which the secondary propulsion unit is actuated to eject the secondary vehicle;

FIG. 11 is a perspective view of a preferred embodiment of the primary propulsion unit for propelling the combined vehicles; and FIG. 12 is a plan view of the lower section of FIG. 11.

DETAILED DESCRIPTION

In FIG. 1, the preferred embodiment of my invention takes the form of a primary vehicle comprising a miniature automobile 10 combined with a secondary vehicle such as a miniature airplane 12. In use, this combination is propelled forwardly for a predetermined time or distance to a point at which the secondary vehicle is projected into flight, the two units continuing travel along divergent paths. These vehicles may take other shapes such as a boat mounting a missile or an aircraft carrying a projectile for subsequent projection into separate flight, and the instant invention is fully applicable to such embodiments.

As shown in the preferred embodiment of the drawings, the primary vehicle 10 is designed similar to a race car having four wheels 14 mounting a sleek appearing body 16 through front and rear axles 17. The top of this body is formed to mount the aircraft 12 by forming a wide groove 18 down the center line of the vehicle to receive the fuselage of the craft and by providing slightly inclined flat wing supports 20 on each side thereof. While the groove 18 may take various aesthetic forms, the body 16 should provide an unobstructed inclined guide surface for the aircraft 12. These described features are sufficient to permit rolling of the primary vehicle 10 along a flat surface while mounting an aircraft for a flight trajectory.

After the combination has traveled a fixed distance, a propulsion system then projects the craft 12 into the air. This system comprises preferably a tension spring 26 or rubber band having one end affixed by pin 28 forwardly on the underneath side of the vehicle. The other end of spring 26 is then affixed to an ejector 30 which may move longitudinally of the body 16 within a slot 32. As shown in FIG. 9, this ejector 30 has a top flange 34 and a bottom flange 36 which extend outwardly to act as flanges to guide the ejector 30 along the slot 32. Extending above flange 34 is a boss 38 having a U-shaped recess 40 for receiving a downward extending projection 42 of the aircraft 12. With this structure, the ejector 30 is biased forward and when pulled rearwardly, may be released to project the craft 12 into the air as it is catapulted forwardly under the bias of spring 26.

To control release of the spring 26 and the craft 12 a lug 44 is provided upon one side of boss 38 of ejector 30 for engagement with a release latch or detent mechanism 50 which has a mating lock lug 52 at its forward end. This latch has a pivotal connection 54 with the body 16 for pivotal movement in a horizontal plane. Thus, retraction of ejector 30 and counterclockwise rotation of latch 50 will restrain the ejector 30 and the aircraft 12 in the rear take-off position. Preferably, a small spring 56 attached to body 16 at 59 biases release latch 50 in the locked position against an abutment 60 carried by body 16. Further, camming surfaces on lock lug 52 and lug 44 permit the lock to automatically open upon rearward movement of ejector 30 against the tension of spring 26.

With the ejector 30 locked in its rear position and the craft 12 mounted on the body 16, the aircraft may be projected forward in flight by the stored energy within spring 26 upon actuation of release latch 30. According to my invention, this actuation is effected subsequent to limited travel of the primary vehicle 10. This delayed actuation is accomplished by reciprocating an actuator 70 into latch 50 against the bias of spring 56, the reciprocation being related to movement of the primary vehicle. This relationship, in the illustrated embodiment, comprises a thread on the rear axle shaft which mounts a threaded actuator constrained against rotation. The rear axle 17, being constrained for rotation with the rear wheels, rotates upon movement of the primary vehicle 12 to reciprocate actuator 70 into an upstanding abutment 72 mounted on release latch 50. The actuator 70 extends upwardly from its engagement with axle 17 with its upper end extending between transversely displaced upper and lower cross bars 74 and 75 carried by the vehicle 10 parallel to axle 17. For appearance, the upper cross bar may take the shape of an air foil or spoiler.

In operation of the aircraft propulsion system, the ejector 30 is merely retracted to the rear and latched with the projection 42 of craft 12 being inserted into the recess 40 of the ejector. Then, the rear wheels 14 are rotated rearwardly to reciprocate the actuator 70 away from the release latch 50 towards the position shown in FIG. 4. When the primary vehicle 10 is placed upon a surface and propelled forward, rotation of the wheel will reciprocate the actuator 70 towards release of the latch 50. The design parameters of wheel size and the pitch of the threads will determine the maximum distance the primary vehicle can travel prior to engagement of actuator 70 with latch 50 to effect release of ejector 30 by pivoting it clockwise against the bias of spring 56.

Once these parameters are established, the operator can select intermediate distances which the primary vehicle will travel prior to projection of craft 12. Further, this selection can be facilitated by correlating the maximum desired forward travel of the vehicle to axial movement of actuator 70. As shown in FIG. 10, the spoiler 74 is marked with indicia of "FIRE, 12 and 24" the numerals 12 and 24 indicating the number of feet the vehicle will travel prior to projection of the craft 12. By rotating the wheels rearwardly, the actuator 70 can be positioned in juxtaposition with the desired indicated travel.

With the unit thus far described, the combined vehicles are manually rolled along a surface until the preselected distance is traversed and the craft 12 is projected. Alternatively, a primary propulsion system in the form of a spring launch (depicted in FIGS. 11 and 12) may be used. This launch comprises an elongated rod 80 extending from a base 82 which carries a positioning handle 84 adapted to be grasped by one's hand to hold the base against the flat surface. Surrounding rod 80 is a coil compression spring 86 for propelling the vehicle 10 forward while a latch 88 having an upstanding lug 90 is positioned on base 82 adjacent the rod. Preferably, the spring launch base is molded of a plastic with the latch 88 being molded integral therewith so as to have an inherent bias to the position shown in FIG. 11.

Cooperating with the spring launch are guide rails 94 and 96 molded into the bottom side of body 16 (See FIG. 6). Enclosing a portion of this track is a cover or latch plate 98, the forward end of which is engaged by projection 90 when the rod 80 is inserted into guide tracks 94 and 96 compressing spring 86. Subsequently, the spring launch and combination are placed on the ground with the operator holding handle 84 and depressing latch 88, the expansion of spring 86 propelling the combination forward for subsequent projection of craft 12 into flight.

The aircraft 12 may take various aerodynamic shapes. As shown, it is of a delta wing appearance with a vertically extending horizontal spoiler 13 formed at the rear of the fuselage. Preferably, it is formed of a very lightweight material such as a polyurethane foam or a molded paper pulp. Maximum flight capability together with an aesthetic appearance is most desired, while functional design criteria requires only the mentioned cooperative relations with body 16 and the ejector 30. However, an important concept of my invention is the low silhouette permitted by the wide groove 18 which receives the fuselage of the aircraft 12 to minimize wind resistance and to provide an initial integral unitary appearance of the combination prior to separate flight.

The invention may take many forms. Being a toy, appearance is quite important and the automobile 10 may carry a plastic molded engine 100 and other desirable features. When used in other environments, such as boats, the threaded shaft 17 might comprise a propeller shaft with an ejector 30 mounted upon the deck. Thus, my invention can be incorporated into various vehicular forms to achieve a delayed propulsion of one vehicle relative to propulsion of a primary vehicle.

I claim:

1. A toy vehicle - airplane combination comprising:

a. miniature wheeled vehicle having a threaded shaft constrained for rotation with one of the wheels of said vehicle;

b. means on said vehicle for carrying a miniature airplane;

c. spring biased propulsion means on said vehicle for ejecting said airplane from said vehicle;

d. detent means for maintaining the bias of said propulsion means until released;

e. release means threadedly mounted on said shaft for releasing said detent means, said release means reciprocating along said shaft in direct proportion to the linear travel of said vehicle;

f. indicator means on said vehicle for preselecting and indicating the distance to be traveled prior to release of said release means; and g. stationary spring launch for receiving said vehicle and for propelling said vehicle along a surface.

2. An apparatus as recited in claim 1 in which said propulsion device is a spring mounted on a support and having detent means for release of said spring.

3. A toy vehicle - aircraft combination comprising:

a. a vehicle having rotating shaft means for reflecting movement of said vehicle;

b. propulsion means carried by said vehicle for propelling an aircraft off of said vehicle;

c. an aircraft mounted upon said vehicle; and d. control means mounted for reciprocal movement on said means for activating said propulsion means subsequent to predetermined travel of said vehicle.

4. An apparatus as recited in claim 3 in which:

a. said vehicle has at least one wheel for engaging a flat surface;

b. said threaded means is constrained for rotation with said wheel; and c. said control means comprises a threaded actuator mounted on said shaft for reciprocal motion thereon and release means for said propulsion means engaged by said actuator subsequent to initial movement of said vehicle to propel said aircraft.

5. An apparatus as recited in claim 2 in which said vehicle carries means for preselecting the magnitude of movement prior to release of said propulsion means.

6. A miniature vehicle - aircraft combination comprising:

a. a wheeled vehicle having a shaft constrained for rotation with one of its wheels;

b. an aircraft mounted upon said vehicle for ejection therefrom;

c. ejection means interposed between said aircraft and said vehicle for ejecting said aircraft from said vehicle; and d. actuator means mounted on said shaft for reciprocating in response to rotation of said one wheel and for actuating said ejector means.

7. An apparatus as recited in claim 6 in which:

a. said shaft is threaded and said actuator means is threaded thereon; and b. said vehicle carries means for precluding rotation of said release means while permitting reciprocal motion thereof.

8. An apparatus as recited in claim 7 in which said vehicle includes means for preselecting and indicating the magnitude of rotation prior to actuation of said release means.

9. An apparatus as recited in claim 8 in which said aircraft is a miniature airplane.

10. A toy vehicle unit comprising:

a. a primary vehicle supporting a second vehicle for limited travel therewith and subsequent travel along a divergent path;

b. spring means carried by said primary vehicle for propelling said second vehicle along its divergent path;

c. actuating means for said spring means comprising a threaded shaft journaled on said primary vehicle for rotation correlated to the motion of said primary vehicle;

d. detent means carried on said primary vehicle for maintaining stored energy in said spring means until released; and e. release means mounted on said threaded shaft for reciprocation correlated to the motion of said primary vehicle and for releasing said detent mechanism and said stored energy for propelling said secondary vehicle along its divergent path.

11. A dual vehicle toy comprising:

a. a primary wheeled vehicle chassis having an elongated groove along its longitudinal center line and an inclined deck formed on said chassis on opposite sides of said groove;

b. a toy aircraft having a body for mounting within said groove and wings extending on either side thereof supported by said inclined deck;

c. a spring biased propulsion unit carried by said chassis within said groove for engaging the body of said aircraft and for propelling said aircraft away from said primary vehicle chassis; and d. control means interconnecting said propulsion unit and a wheel of said chassis for actuating said propulsion unit after said chassis has traveled a predetermined distance.

12. An apparatus as recited in claim 11 in which said toy aircraft is of a delta wing appearance and carries a fixed vertically extending horizontal air foil at the rear of the body.

* * * * *